US006214113B1

(12) United States Patent
Spatafora

(10) Patent No.: US 6,214,113 B1
(45) Date of Patent: Apr. 10, 2001

(54) GUMMING DEVICE

(75) Inventor: Mario Spatafora, Bologna (IT)

(73) Assignee: G.D. Societa per Azioni, Bologna (IT)

( * ) Notice: Subject to any disclaimer, the term of this patent is extended or adjusted under 35 U.S.C. 154(b) by 0 days.

(21) Appl. No.: 09/520,062

(22) Filed: Mar. 7, 2000

Related U.S. Application Data

(63) Continuation of application No. PCT/IT99/00223, filed on Jul. 16, 1999.

(30) Foreign Application Priority Data

Jul. 16, 1998 (IT) ..... B098A0439

(51) Int. Cl.[7] ..... B05C 1/08
(52) U.S. Cl. ..... 118/258; 222/410; 222/63
(58) Field of Search ..... 222/52, 410, 414, 222/63; 118/258, 202

(56) References Cited

U.S. PATENT DOCUMENTS

| | | | | |
|---|---|---|---|---|
| 3,152,011 | | 10/1964 | Gerard | 118/211 |
| 5,650,193 | | 7/1997 | Swain et al. | 427/11 |
| 5,776,248 | * | 7/1998 | Spatafora | 118/202 |
| 5,885,348 | * | 3/1999 | Spatafora | 118/258 |

* cited by examiner

*Primary Examiner*—Philippe Derakshani
(74) *Attorney, Agent, or Firm*—Ladas & Parry

(57) ABSTRACT

A gumming device wherein two coaxial disks of equal diameter are rotated synchronously at continuous speed, and define in between, a central cavity communicating on one side with a tank of liquid gum under pressure, and on the other side with the outside atmosphere through an opening which extends along at least one portion of the outer circumference of the two disks and is variable in width by varying the distance between the two disks.

11 Claims, 3 Drawing Sheets

GUMMING DEVICE

This application is a continuation of copending application International Application PCT/IT99/00223 filed on Jul. 16, 1999 and which designated the U.S., claims the benefit thereof and incorporates the same by reference.

TECHNICAL FIELD

The present invention relates to a gumming device.

The present invention is especially suitable for gumming sheet material on a packing machine, to which the following description refers purely by way of example.

BACKGROUND ART

Known units for gumming sheet material normally feature mechanical, and in particular roller or spray, gum applying devices, which, though highly efficient, involve several drawbacks.

In particular, roller devices operate at relatively slow speed, well below the requirements of modern machinery, particularly modern packing machines, and, by featuring a gumming roller rotating partly immersed in a bath of gum, are particularly "dirty" and therefore require frequent cleaning. Moreover, during machine stoppages, the bath of gum tends to dry by remaining in contact with the air with no provision for stirring the gum.

On the other hand, spray devices are relatively expensive and unreliable, due to frequent clogging of the spray nozzles.

DISCLOSURE OF INVENTION

It is an object of the present invention to provide a gumming device designed to eliminate the aforementioned drawbacks, and which, in particular, is straightforward in design and cheap to produce, while at the same time permitting fast, accurate gumming.

According to the present invention, there is provided a gumming device comprising two disks coaxial with each other and of equal diameter; a central cavity defined between the two disks; supply means for feeding gum under pressure to said central cavity; and drive means for rotating said two disks synchronously and continuously about their axis; said two disks defining, in between, an outlet opening for the gum; and said outlet opening extending along at least one portion of an outer circumference of said two disks.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
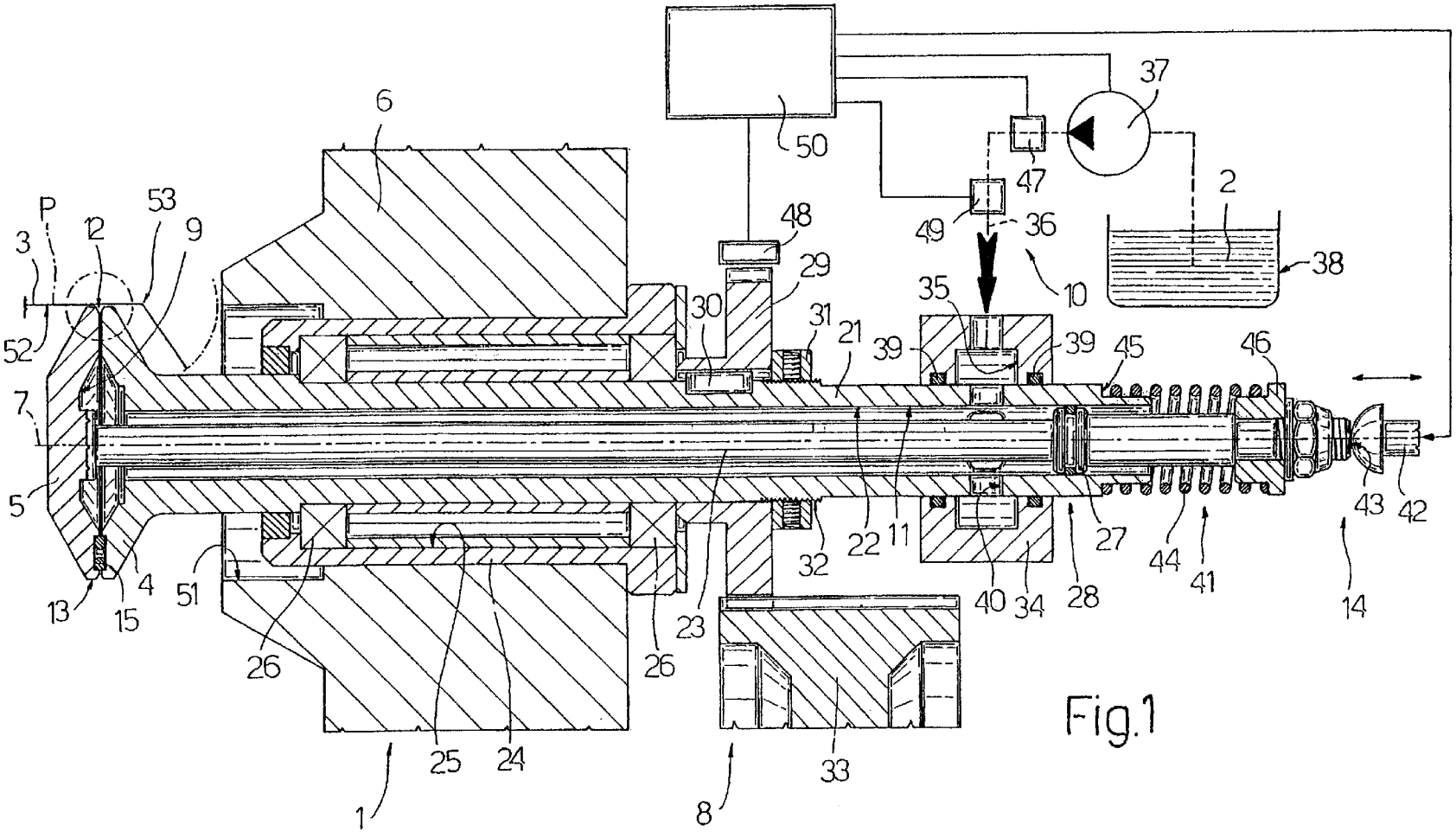
FIGS. 1 and 2 show two lateral sections of a preferred embodiment of the gumming device according to the present invention in two different operating configurations.

Number 1 in FIG. 1 indicates as a whole a gumming device for depositing liquid gum 2 onto a blank 3 fed along a path P on a known packing machine (not shown).

Gumming device 1 comprises an inner disk 4 and an outer disk 5 of equal diameter, which are fitted coaxially with each other to a frame 6 and are rotated synchronously and continuously about a central axis 7 by a drive device 8.

A central cavity 9 is defined between disks 4 and 5, communicates on one side with a device 10 for supplying gum 2 at a given pressure along a channel 11 extending along axis 7, and communicates externally on the other side through at least one outlet opening 12 for gum 2. In the example shown, openings 12 are two in number, are defined between disks 4 and 5, and each extend along a respective portion of an outer circumference 13 of disks 4 and 5.

Disks 4 and 5 are mounted to slide with respect to each other along axis 7, and are connected to an actuating device 14 for varying the width A (FIG. 3) of openings 12 between a zero closed value and a given maximum open value by varying the distance between disks 4 and 5 along axis 7.

Figure 4:
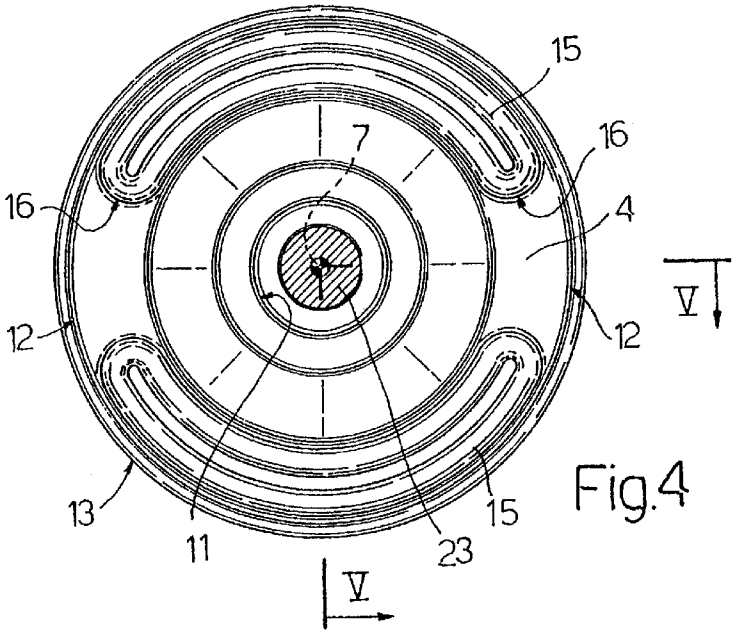
FIG. 4 shows a larger-scale front view, with parts removed for clarity, of a further detail in FIG. 1.

As shown in FIG. 4, inner disk 4 supports two annular seals 15, which are located in diametrically opposite positions on the surface of disk 4 facing disk 5 to limit openings 12 to respective given diametrically opposite portions of outer circumference 13.

Figure 3A:
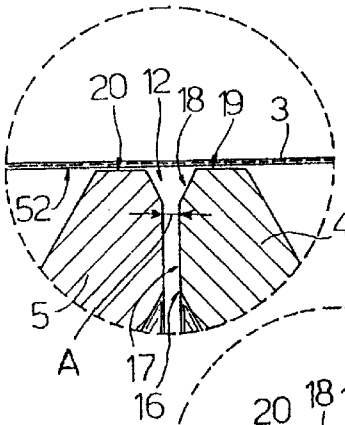
FIG. 3 shows a larger-scale lateral section of two instants in the operation of a detail in FIG. 1.

As shown in FIG. 3*a*, each outlet opening 12 is defined by the outlet end of a respective channel 16 communicating at one end with the outside and at the other end with central cavity 9, and which comprises a constant-section first portion 17 communicating with central cavity 9, and a second portion 18 communicating with portion 17 and with the outside and having an outwardly increasing section.

Disks 4 and 5 comprise respective lateral surfaces 19 and 20, which are substantially cylindrical, are coaxial with each other and with axis 7, define, in between and together with seals 15, the two openings 12, and act as a support, in use, for blank 3.

As shown in FIG. 1, disk 4 is fitted to a hollow shaft 21 having an inner conduit 22 communicating with central cavity 9; and disk 5 is fitted to a shaft 23 housed coaxially inside shaft 21 to define, inside conduit 22, annular-section channel 11 for supplying gum 2 to central cavity 9.

Frame 6 supports a cylindrical body 24, which is fitted to frame 6 coaxially with axis 7, has a central hole 25, and is fitted to frame 6 so as to slide along axis 7 and with respect to frame 6 under the control of an actuating device (not shown). Shaft 21 is inserted inside hole 25, and is supported by body 24 by means of a pair of thrust ball bearings 26 so as to rotate about axis 7 in an axially-fixed position with respect to body 24.

Shaft 23 projects from shaft 21 via the interposition of a sealing element 27, which is located at the opposite end 28 of conduit 22 to that communicating with central cavity 9, enables shaft 23 to slide with respect to shaft 21, and prevents gum 2 from issuing from the opposite end of channel 11 to cavity 9.

Drive device 8 comprises a ring gear 29, which is fitted coaxially about shaft 21, is fitted to shaft 21 by means of a key 30, and is held in place by a ring nut 31 screwed to a threaded outer portion 32 of shaft 21. Drive device 8 also comprises a gear 33, which is located with its axis (not shown) parallel to axis 7, is connected in axially-sliding manner to ring gear 29, and is rotated at constant speed by a known motor (not shown).

Device 10 for supplying gum 2 comprises an annular distributor 34, in which is defined an annular inner cavity 35 communicating, along a conduit 36, with a pump 37 for drawing gum 2 from a tank 38. Distributor 34 and cavity 35 are fitted through with shaft 21, which is mounted to rotate with respect to distributor 34; two annular sealing elements 39 are fitted to distributor 34 and connected to shaft 21 to seal cavity 35 and prevent gum 2 from leaking along the outer periphery of shaft 21; and shaft 21 has a transverse through hole 40 formed through the portion of shaft 21 surrounded by cavity 35 to connect cavity 35 permanently to channel 11.

Actuating device 14 exerts axial thrust on shaft 23, in opposition to an elastic element 41, to move shaft 23 axially with respect to shaft 21; and elastic element 41 transmits a drive torque from shaft 21 to shaft 23 to rotate shaft 23 synchronously with shaft 21, and normally maintains disks 4 and 5 in a closed position corresponding to a zero width A of openings 12.

Actuating device 14 comprises a push rod 42, which is movable along axis 7 and connected to one end 43 of shaft 23; and elastic element 41 comprises a spring 44, which is wound coaxially about shaft 23 and compressed between one end 45 of shaft 21 and an annular stop body 46 integral with end 43 of shaft 23.

Actuating device 14 also comprises a sensor 47 for detecting the pressure value at which gum 2 is supplied to central cavity 9; a sensor 48 for detecting the rotation speed value of disks 4 and 5; a sensor 49 for detecting the temperature value of gum 2; and a control unit 50 connected to sensors 47, 48, 49 and for adjusting width A of openings 12 as a function of the above values.

Figure 2:
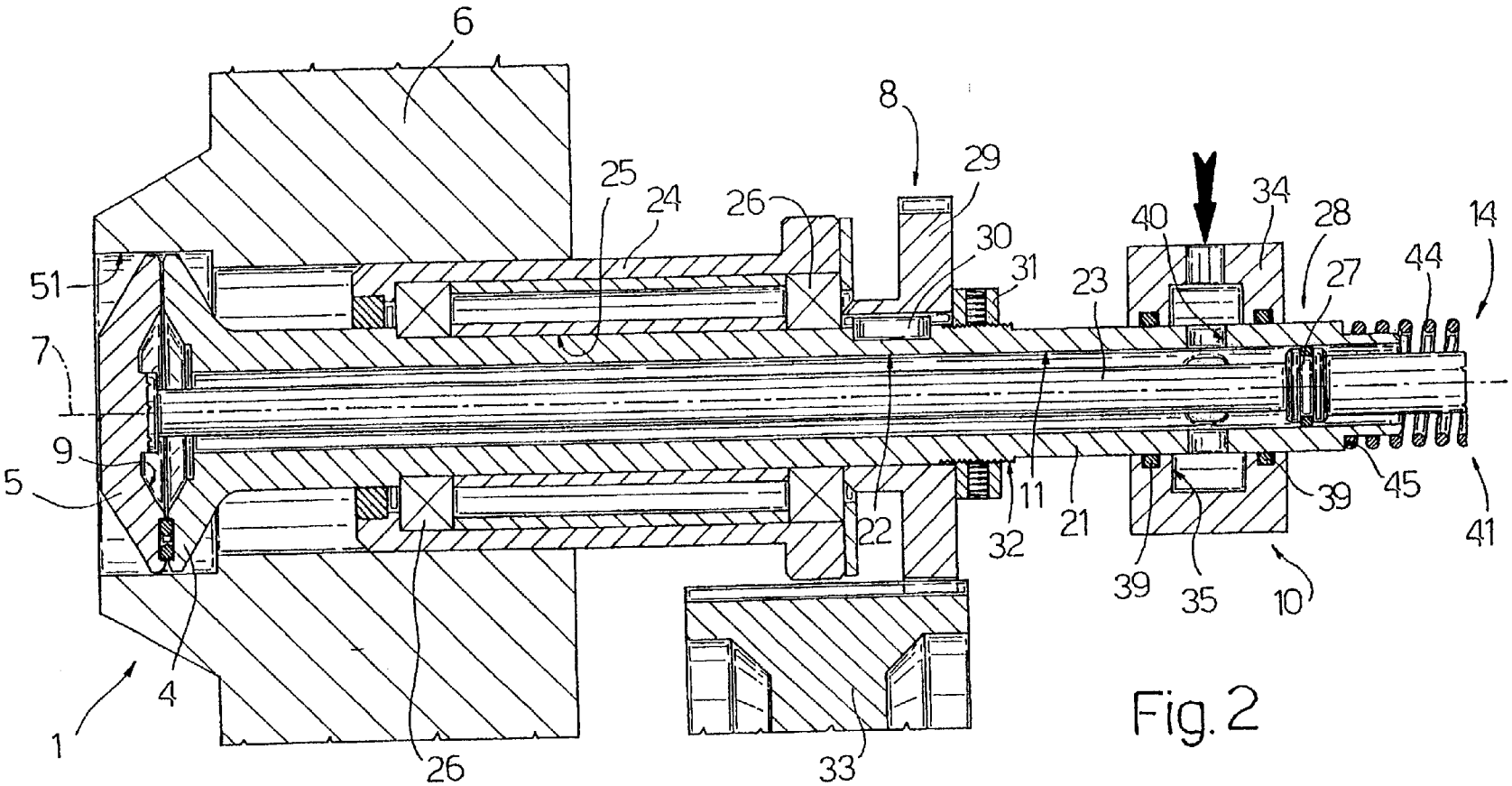

A cylindrical cavity 51 is defined, coaxially with axis 7, in frame 6 to house disks 4 and 5; and said actuating device (not shown) provides for moving body 24 (and hence disks 4 and 5), distributor 34 and push rod 42 synchronously along axis 7 between a withdrawn rest position (FIG. 2) in which disks 4 and 5 are housed inside cavity 51, and an extracted work position (FIG. 1) in which disks 4 and 5 are located outside cavity 51 and along the path P of blank 3.

Operation of gumming device 1 will now be described with particular reference to FIG. 1, and as of the instant in which disks 4 and 5 are set to said closed position corresponding to said zero width A of openings 12.

In connection with the above, it should be pointed out that disks 4 and 5 are normally maintained in the closed position when gumming device 1 is idle, so as to isolate the gum 2 in cavity 9 from the outside atmosphere.

To begin with, drive device 8 rotates shaft 21, and hence shaft 23 angularly integral with shaft 21, at substantially constant angular speed; and, at the same time, pump 37 feeds gum 2 under pressure to cavity 35 and through hole 40 and along channel 11 to central cavity 9.

Actuating device 14 then moves push rod 42 along axis 7 to move disk 5 axially with respect to disk 4 and increase the width A of each opening 12 to a given value greater than zero and depending on the pressure and temperature of gum 2, and on the speed of shafts 21 and 23, i.e. of disks 4 and 5.

Figure 3B:
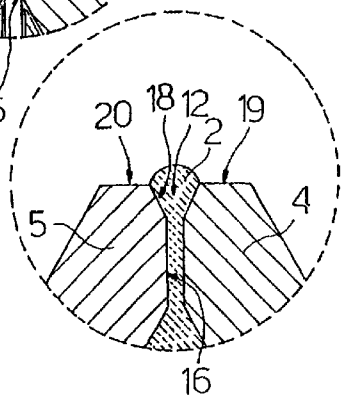
Figure 5:
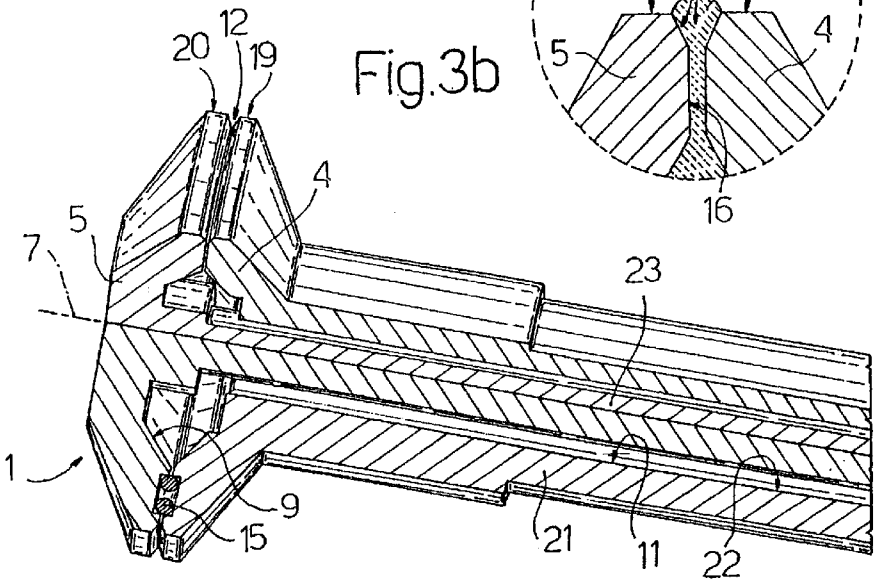
FIG. 5 shows a view in perspective, sectioned along line V—V in FIG. 4, of part of the FIG. 1 gumming device.

As shown in FIG. 3*b*, the centrifugal force produced by disks 4 and 5 rotating continuously about axis 7, and the supply pressure exerted by pump 37 cause gum 2 to flow along channel 16 to each opening 12, outside which a drop of gum 2 is formed due to capillarity and adhesion of gum 2 to the facing surfaces of disks 4 and 5.

As blank 3 is fed along path P, the gum 2 emitted as described above from each opening 12 is brought into contact with and deposited onto a surface 52 of blank 3.

By virtue of the two seals 15, gumming device 1 provides for gumming surface 52 of, blank 3 along a discontinuous line.

Width A of each opening 12 is regulated by control unit 50 as a function of the pressure and temperature of gum 2 and the speed of shafts 21 and 23, i.e. of disks 4 and 5, so as to Feed opening 12 with a substantially constant amount of gum.

As shown in FIG. 1, surfaces 19 and 20 of disks 4 and 5 may act as a supporting spindle by which to fold blank 3 along a bend line 53 in the course of the above gumming operations.

In an alternative embodiment not shown, frame 6 supports a known cleaning device for removing any leftover gum 2 from surfaces 19 and 20 and from the outer surface of portion 18 of channel 16 once the gumming operations are completed. In one embodiment not shown, the cleaning device comprises a rod with one end shaped to fit between disks 4 and 5, which, as they rotate with respect to the rod, provide for removing any leftover gum.

In an alternative embodiment not shown, the cleaning device comprises a water spray nozzle for removing any leftover gum by directing a jet of water between disks 4 and 5.

Said cleaning devices may cooperate with disks 4 and 5 in either the withdrawn rest position or the extracted work position.

What is claimed is:

1. A gumming device comprising two disks (4, 5) coaxial with each other and of equal diameter; a central cavity (9) defined between the two disks (4, 5); supply means (10) for feeding gum (2) under pressure to said central cavity (9); and drive means (8) for rotating said two disks (4, 5) synchronously and continuously about their axis (7); said two disks (4, 5) defining, in between, an outlet opening (12) for the gum (2); and said outlet opening (12) extending along at least one portion of an outer circumference (13) of said two disks (4, 5).

2. A gumming device as claimed in claim 1, and also comprising actuating means (14) for varying a width (A) of said outlet opening (12) between a closed value equal to zero and a given maximum open value.

3. A gumming device as claimed in claim 2, wherein said two disks (4, 5) are mounted to slide with respect to each other along said axis (7); said actuating means (14) being means for varying a distance between said two disks (4, 5).

4. A gumming device as claimed in claim 1, and comprising deformable sealing means (15) located between said two disks (4, 5) to limit said outlet opening (12) for the gum (2) to a given portion of said outer circumference (13).

5. A gumming device as claimed in claim 1, wherein said outlet opening (12) for the gum (2) is defined by an outlet end of a channel (16) communicating externally at one end and with said central cavity (9) at the other end, and comprising a constant-section first portion (17) communicating with said central cavity (9), and a second portion (18) communicating externally and with said first portion (17) and having a section increasing outwards.

6. A gumming device as claimed in claim 5, wherein said two disks (4, 5) comprise respective coaxial, substantially cylindrical lateral surfaces (19, 20) separated by said outlet opening (12).

7. A gumming device as claimed in claim 1, wherein a first (4) of said two disks (4, 5) is fitted to a hollow first shaft (21) having an inner conduit (22) communicating with said central cavity (9); a second (5) of said two disks (4, 5) being fitted to a second shaft (23) extending coaxially inside said first shaft (21) to define, inside said inner conduit (22), an annular-section channel (11) for feeding the gum (2) to said central cavity (9).

8. A gumming device as claimed in claim 3, wherein said second shaft (23) is mounted to slide axially with respect to said first shaft (21); said actuating means (14) being thrust means for moving said second shaft (23) axially with respect to said first shaft (21).

9. A gumming device as claimed in claim 8, wherein said actuating means (14) comprise elastic means (41) for normally maintaining said two disks (4, 5) in a closed position corresponding to said closed value of said outlet opening (12); said actuating means (14) acting, in use, in opposition to said elastic means (41).

10. A gumming device as claimed in claim 2, wherein said actuating means (14) comprise a first sensor (47) for detecting the pressure value at which the gum (2) is supplied to said central cavity (9); a second sensor (48) for detecting the rotation speed value of said two disks (4, 5); a third sensor (49) for detecting the temperature value of said gum (2); and a control unit (50) connected to said sensors (47, 48, 49) and for regulating the width (A) of said outlet opening (12) for the gum (2) as a function of said values.

11. A gumming device as claimed in any claim 1, and comprising a support (6) for said two disks (4, 5); said support (6) having a seating cavity (51); and said two disks (4, 5) being movable synchronously along said axis (7) between a withdrawn rest position in which the two disks (4, 5) are housed inside said seating cavity (51), and an extracted work position in which said two disks (4, 5) are located outside said seating cavity (51).

* * * * *

UNITED STATES PATENT AND TRADEMARK OFFICE

CERTIFICATE OF CORRECTION

PATENT NO. : 6,214,113 B1
DATED : April 10, 2001
INVENTOR(S) : Mario Spatafora

It is certified that error appears in the above-identified patent and that said Letters Patent is hereby corrected as shown below:

Title page,
Item [73], "D." should read -- D -- and item [30], "B098A0439" should read -- B098A000439 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*